United States Patent [19]

Bartel

[11] 4,304,305

[45] Dec. 8, 1981

[54] FRAME FOR MOUNTING TILT AND ANGLED DOZER BLADE TO TRACTORS

[75] Inventor: Walter A. Bartel, Fairview, Okla.

[73] Assignee: Waldon, Inc., Fairview, Okla.

[21] Appl. No.: 51,195

[22] Filed: Jun. 22, 1979

[51] Int. Cl.[3] ..... E02F 3/76

[52] U.S. Cl. ..... 172/274; 172/817; 172/821; 414/686

[58] Field of Search ..... 172/801–809, 172/273, 274, 272, 776; 414/686, 727, 722, 697, 710, 714

[56] References Cited

U.S. PATENT DOCUMENTS

| | | | |
|---|---|---|---|
| 2,748,960 | 6/1956 | Stueland | 172/274 |
| 2,950,550 | 8/1960 | French | 172/804 |
| 2,973,592 | 3/1961 | Abel | 172/804 |
| 3,199,236 | 8/1965 | Bartel | 172/801 |
| 3,215,292 | 11/1965 | Halls | 414/707 |
| 3,565,181 | 2/1971 | Bahm | 172/801 |
| 3,670,825 | 6/1972 | Asal | 172/804 |
| 3,773,116 | 11/1973 | Coontz | 172/804 |
| 3,780,813 | 12/1973 | Davis | 172/801 |
| 4,222,442 | 9/1980 | Westendorf | 172/273 |

OTHER PUBLICATIONS

Case Model 850B, Angle Tilt Dozer Blade parts Catalog, J. I. Case Co., Racine, Wisc. 6/1977.

*Primary Examiner*—Richard J. Johnson
*Attorney, Agent, or Firm*—Head & Johnson

[57] ABSTRACT

A detachable moldboard dozer blade assembly for tractors having a push frame pivotally attached at a rear end thereof to the underchassis of a tractor. A frame structure is attached to the forward end of the push and provides for a vertical pivotal axis for the attachment of the dozer blade assembly. An attachment plate is pivotally connected transversely to the frame structure for blade movement in a horizontal plane and shim and plate means retain the attachment of the dozer blade assembly. An attachment plate is pivotally connected transversely to the frame structure for blade movement in a horizontal plane and shim and plate means retain the attachment plate to the dozer blade to permit vertical or tilt movement of the dozer blade relative to the attachment plate. Hydraulic piston means extend from the push frame to the attachment plate and from the attachment plate to the dozer blade to move the dozer blade about a vertical and horizontal plane.

1 Claim, 9 Drawing Figures

4
4
10
12
14
16
17
19
20
21
22
23
24
30
32
34
36
40
42
44
46
48
50
52
54
60
62
64
70
72
74
76
78
80

FRAME FOR MOUNTING TILT AND ANGLED DOZER BLADE TO TRACTORS

BACKGROUND

The invention is in the field of attachments for existing tractors.

There are many instances in farm and ranch usage for dozer blade operations to build roads, move dirt or other materials, etc. Suitable power for doing such operation is available by way of the tractor used on such farms and ranches. Need for dozing operations usually does not justify a bulldozer unit in and of itself. However, it has not been easy to attach a dozer blade readily and easily to the chassis of the tractor, nor has it been readily available to have dozer blades which can be angled in a horizontal direction about a vertical axis and thereby push and/or move material to one side or the other and/or tilt the dozer blade in a vertical direction about a horizontal axis where it is desired to use the corner of the dozer blade for extra digging or ditching operations and/or slope material, such as on roads.

SUMMARY

This invention is directed to a moldboard or dozer blade for tractors of the two-wheel-drive or four-wheel-drive type. Essentially, the invention comprises a basic frame attached to the underchassis of the tractor and which may be permanently carried by the tractor when the dozer blade is dismounted at the option of the operator. In one embodiment the push frame includes an over-the-front axle lift frame member which is attached to the dozer blade and maintained there as an assembly, but which may be readily attached to the tractor with minimal effort and procedure by the operator. The front or forward end of the push or lift frame includes a vertical pivot axis to which an attachment plate, which extends horizontally transverse of the frame, is vertically connected to the vertical pivot axis. This provides movement of the attachment plate from a 90° position to the angle in a horizontal direction or plane either side of the vertical pivot axis. The ends of the attachment plate are retained to the dozer blade in such a manner as to permit vertical or tilt movement of the blade, relative to the attachment plate, in a vertical direction about a horizontal pivot axis through the center line of the chassis. First and second adjustable means each connected at one end to the push frame and at the other end to the attachment plate extend on each side of the vertical pivot axis and are adapted to move and/or retain the attachment plate and hence the dozer blade which is attached at a desired angle to the horizontal. Such adjustable means may be either fixed mechanical linkages, e.g. turnbuckles or hydraulic piston and cylinder actuated devices. A third adjustable means has one end connected to the attachment plate and the other end to the dozer blade for movement of the dozer blade and/or retain the same as a tilt or angle to the vertical. Such a device may be mechanical, e.g. turnbuckle or a hydraulic-actuated cylinder and piston means.

DETAILED DESCRIPTION OF THE DRAWINGS

Before explaining the present invention in detail, it is to be understood that the invention is not limited in its application to the details of construction and arrangement of parts illustrated in the accompanying drawings since the invention is capable of other embodiments and of being practiced or carried out in a variety of ways.

Also, it is to be understood that the phraseology or terminology employed herein is for the purpose of description and not of limitation.

Figure 1:
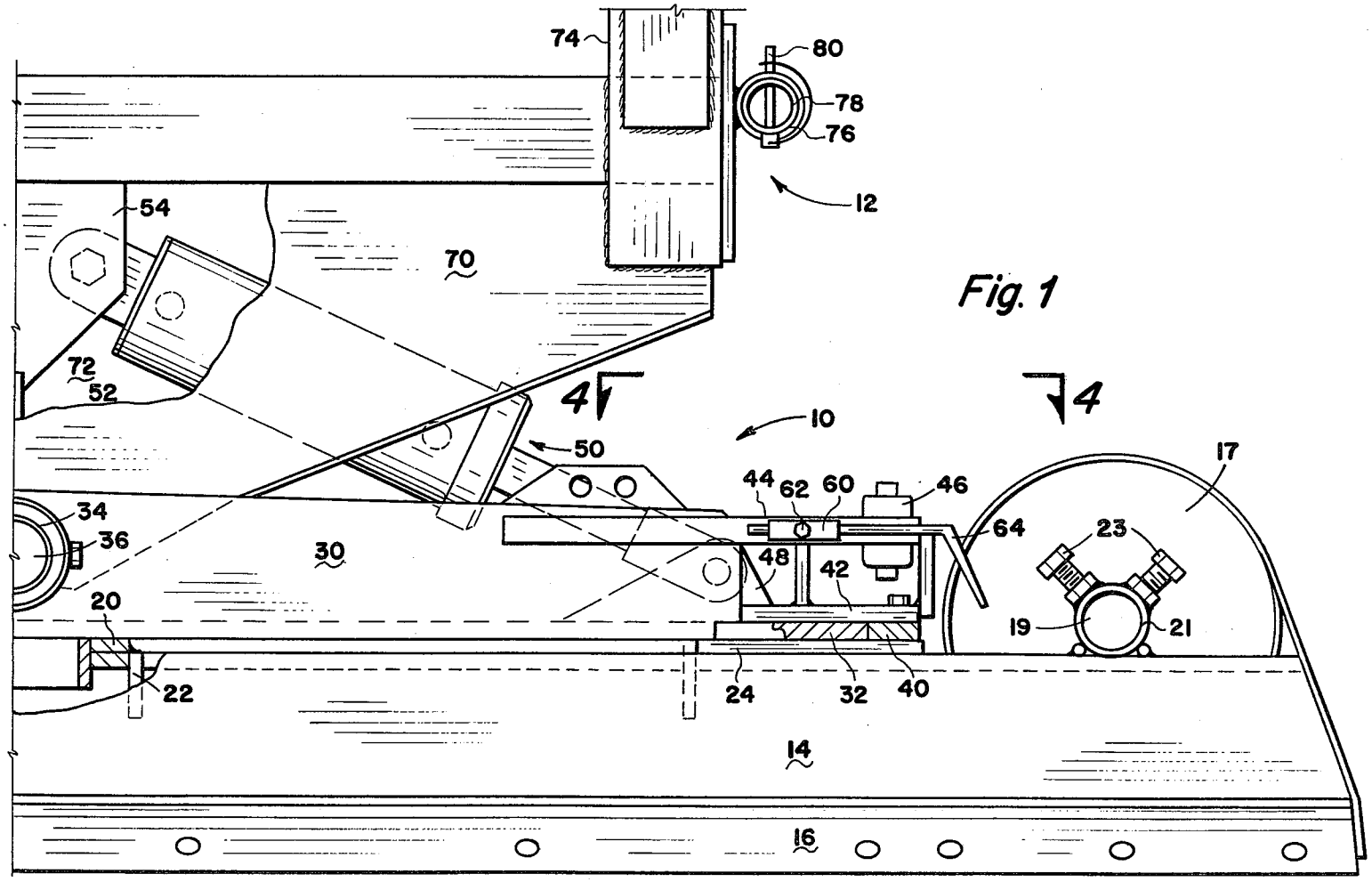
FIG. 1 is a top elevation partly sectional view of a push lift frame and dozer blade assembly showing one half of the assembly, a mirror image of same being on the other side and not fully shown. This assembly and push frame is particularly adaptable to two-wheel-drive tractors.

Referring now to FIG. 1, the dozer blade assembly is generally designated by the numeral 10 and the lift frame assembly of this embodiment by the numeral 12. The moldboard or dozer structure 14 is curved in a concave manner towards the work and includes a hardened steel blade 16 suitably attached to the lower end. An end bit (not shown) may be attached to each lower corner of the dozer blade assembly such that it provides extra trenching ability during the tilt position of the blade. On the back side of the dozer blade assembly is a centrally located bearing plate 20 which is welded or otherwise attached by suitable brackets 22. A spacer bearing plate 24 is provided adjacent each end, against which the end surface 32 of tilt attachment plate 30 rests. The attachment plate 30 includes a vertical opening 34 in the upper and lower flanges at the center of the attachment which are alignable with a respective center line opening in the lift frame assembly. A bearing pivot 36 is placed through these aligned vertical openings and interconnects to the attachment frame so as to pivot as an assembly therewith. The attachment 30 is retained to the blade 14, using one or more shims 40 and a retainer plate 42, which allows relative movement between the attachment plate 30 and the blade 14 as hereafter described. An arm 44 is attached to the top flange of the attachment 30 and extends outward to receive one end of a hydraulic actuator or mechanical actuating device 46. The other end is attached to bracket 41 formed as a part of retainer plate 42. On the back side of the attachment plate are flanges 48 adapted to receive one end of a hydraulic actuator 50 (its counterpart 52 on the other side) while the other end of the actuator is retained by flange plates 54 as a part of the lift frame. Atop the extension arm 44 is a sleeve 60 having a lock nut 62. A blade level indicator arm 64 is adjustable therein to provide a visual indication to an operator as to the level or tilt of the dozer blade. The dozer blade may further include a skid shoe 17, which has a vertical shaft portion 19, which is held and retained within sleeve 21 by bolts 23. The lift frame assembly at the forward end includes upper and lower support plates 70 and 72, respectively, which are interconnected to parallel side frame members 74, only one of which is shown in this view. (See FIGS. 5 and 6 for a side elevational view) A sleeve 76 is attached to each side of the lift frame and it is adapted to receive therein stand 78. The stand includes a ground flange 79 portion, not shown in the view, and a plurality of openings through which a retaining pin 80 extends to stop the movement in a downward direction when the dozer blade is attached to the tractor and in use, or upward movement when the lift frame and dozer blade is detached from the tractor and rests on the ground, as shown in FIGS. 5 and 6.

Figure 2:
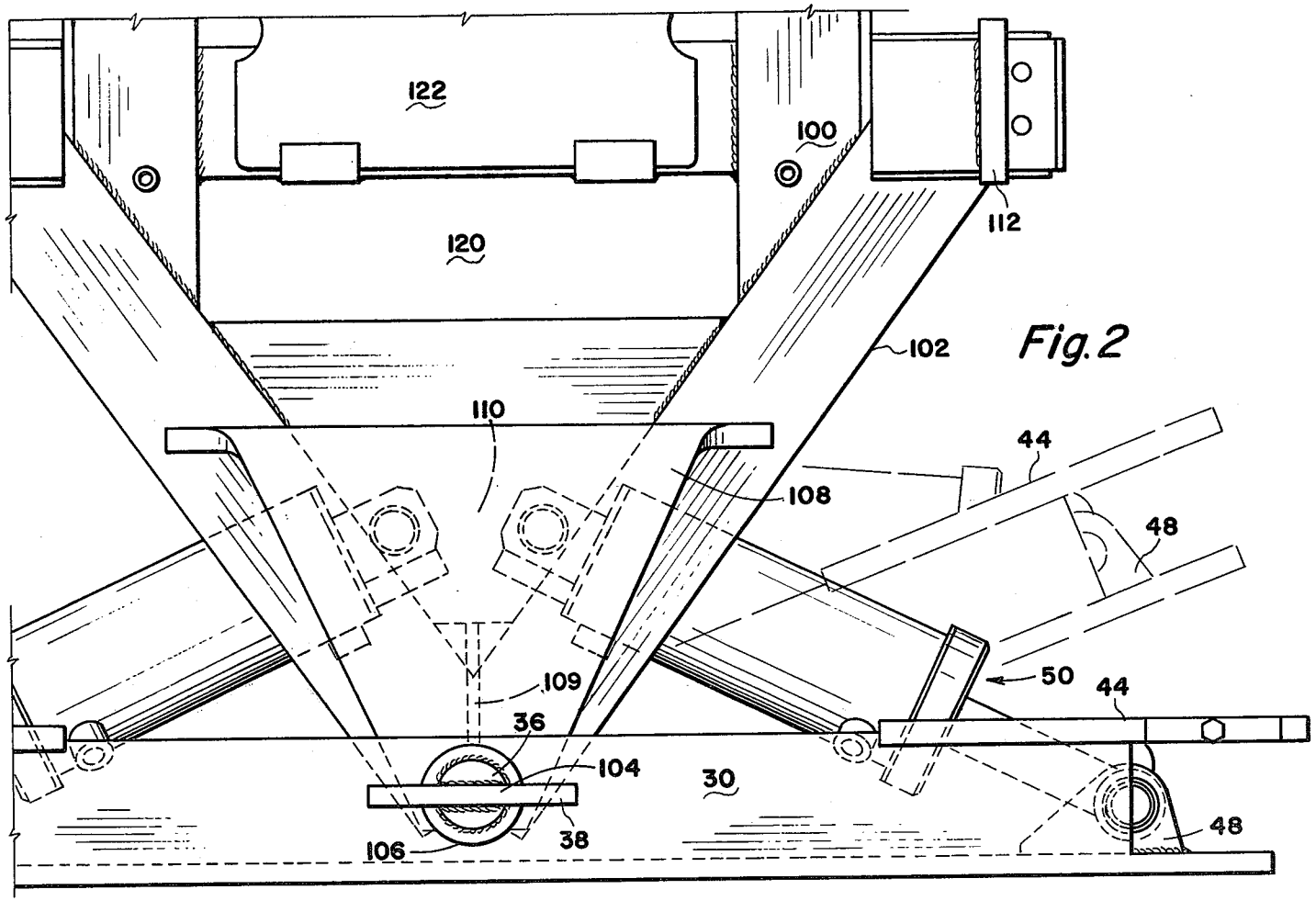
FIG. 2 is a top elevational view of a push frame and dozer blade, partly shown, as another embodiment, in particular application to four-wheel-drive tractors.
Figure 3:
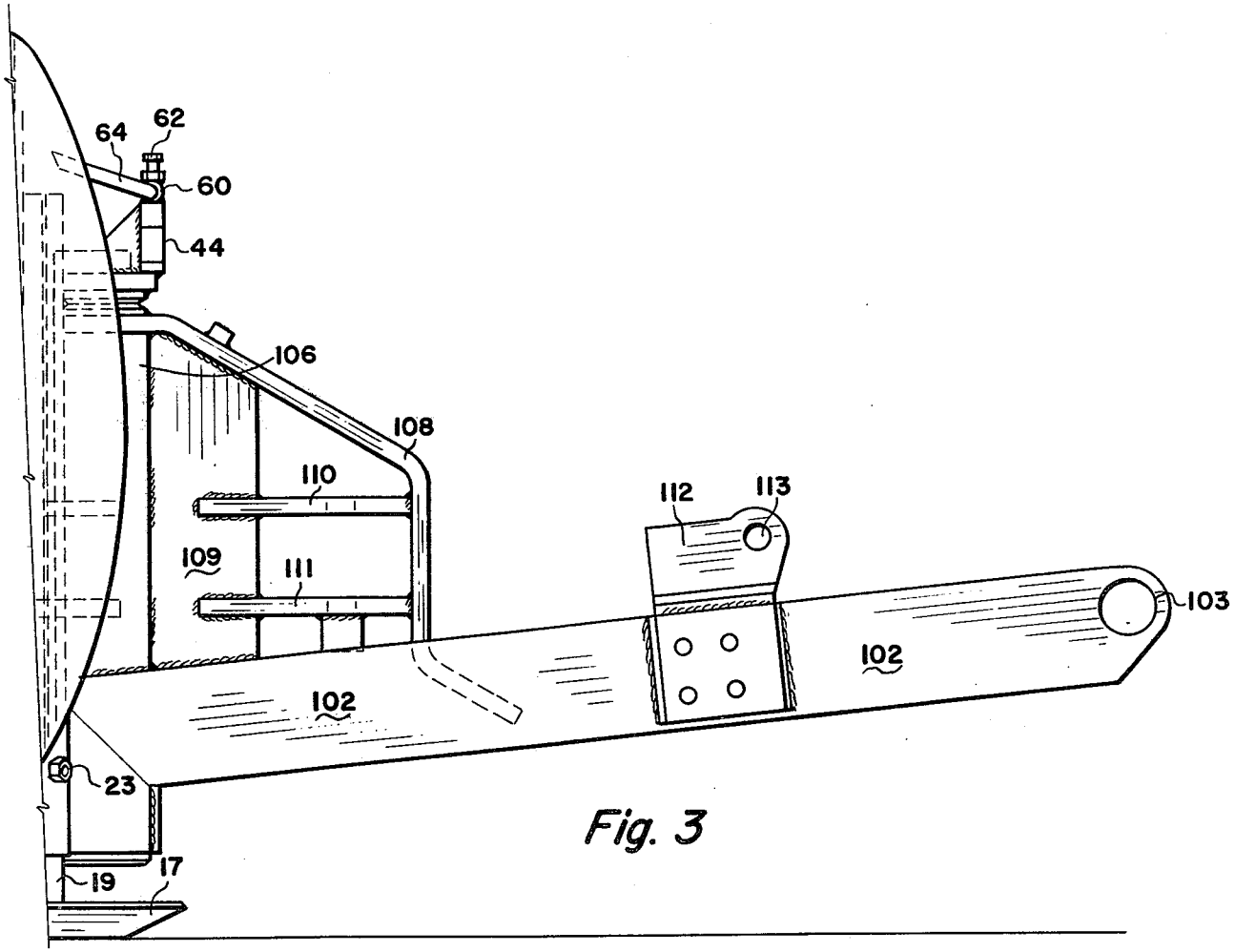
FIG. 3 is a partial side elevation view of the forward portion of a push frame and dozer blade assembly taken along the lines 3—3 of FIG. 2.
Figure 3A:
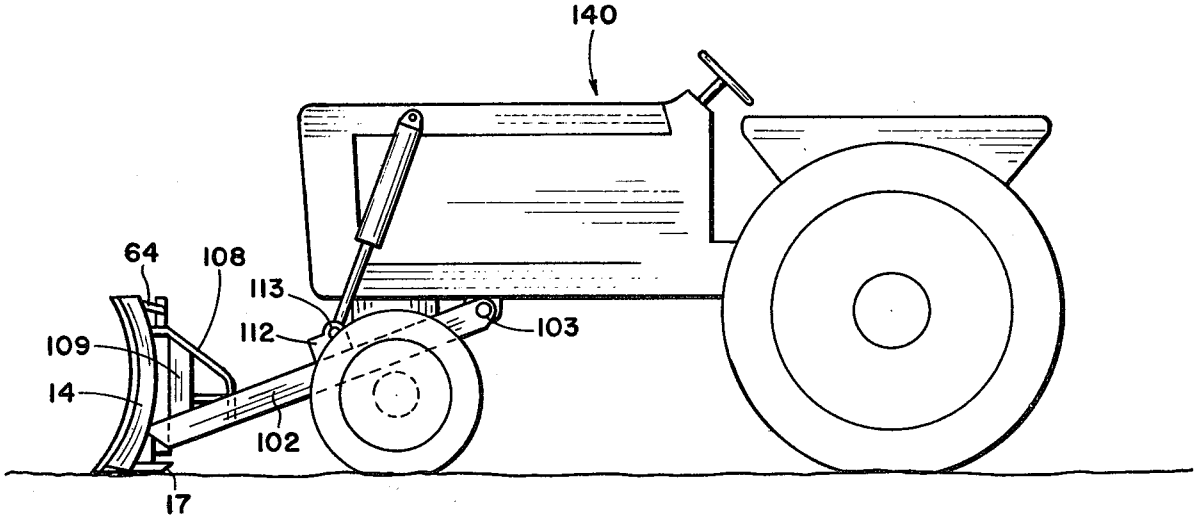
FIG. 3A is a side elevational view of one embodiment of the dozer blade assembly attached to the tractor.
Figure 4:
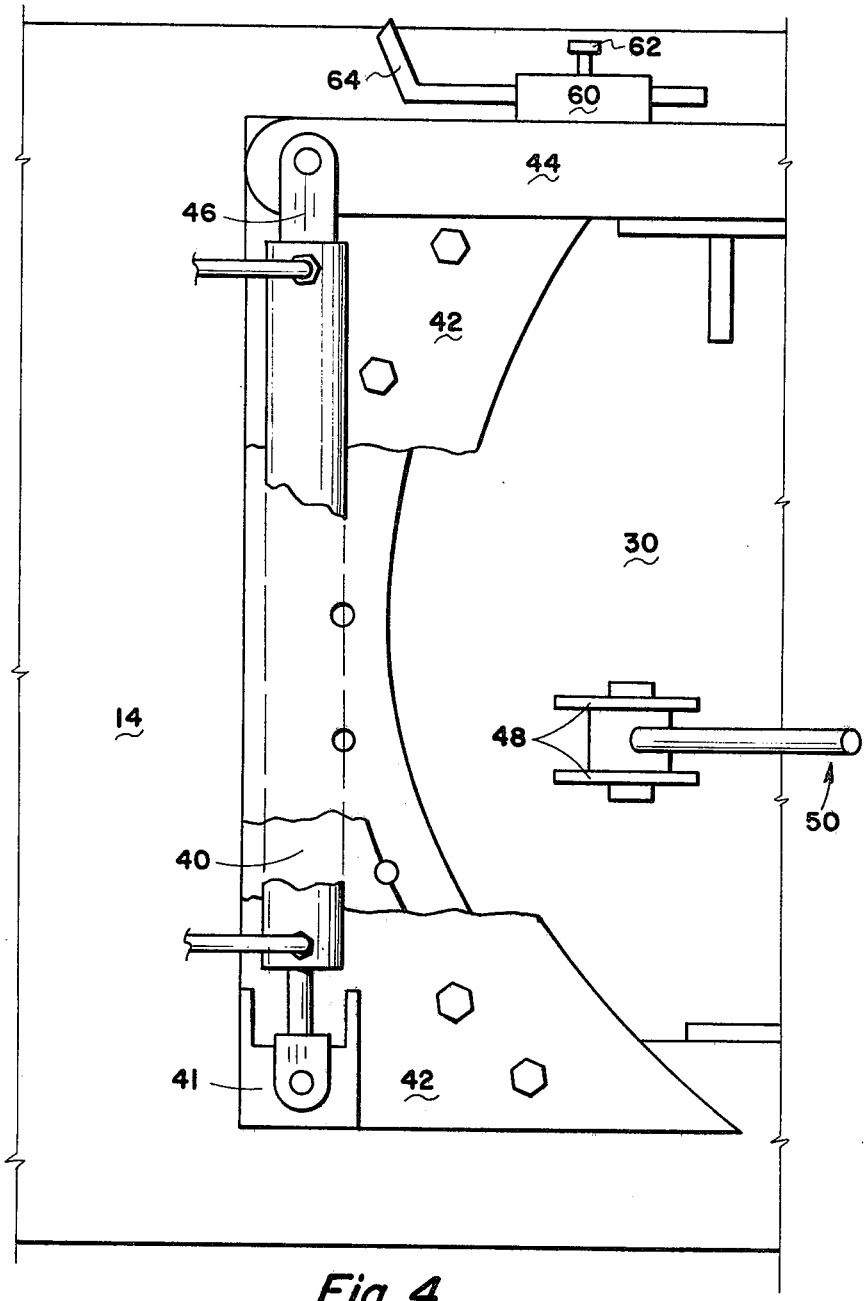
FIG. 4 is a partial sectional and partial cutaway view taken along the line 4—4 of FIG. 1, describing the connection of the attachment plate and the dozer blade.

Referring now to FIGS. 2, 3 and 3 of this invention, the forward portion of a push frame and dozer blade assembly is shown. The view represents one half of the assembly, the mirror image of same being on the other side of the center line. This particular apparatus is adaptable to four-wheel-drive tractor assemblies and includes push frame arms 100, which extend parallel rearwardly into pivot attachment at 103 with the underchassis of the tractor. The forward end of the push frame includes an angular arm member 102, which terminates at its forward end with the vertical pivot axis 104 to which the attachment plate 30 is interconnected and, as previously described in regard to FIG. 1. The vertical support comes by way of a vertical sleeve 106 through which connector pin 36, having a handle portion 38 thereon, interconnects the push frame and the attachment plate 30 upper and lower flanges. Structural plates 10, 109, 110, and 114 support the vertical sleeve. Members 112 on each side of the push frame are adaptable to provide means 113 for attachment of a hydraulic cylinder, one end of which is attached to the tractor chassis and the other end to plate 112 for movement of the push frame and assembly upward and downward. The push frame can include suitable front cross bracing 120 and rear bracing, not shown. A cover 122 protects the hydraulic selector valves and connections. The rear end of the push frame 102 as shown in FIG. 3A includes an opening 103 on each side, which is pivotally attached to the underchassis of the tractor.

Figure 5:
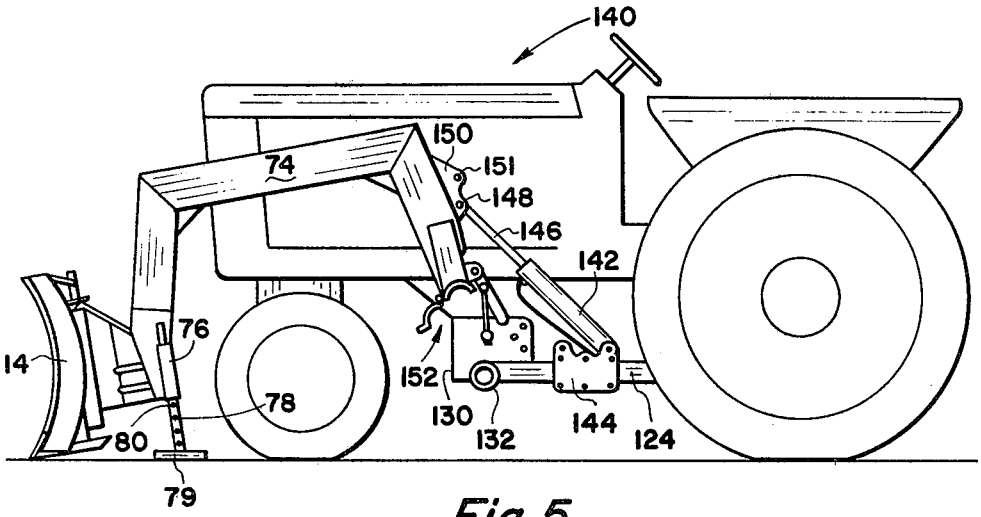
FIGS. 5 and 6 are depictive of the manner of attaching the dozer blade and lift-push frame to a push frame on an existing two-wheel-drive tractor.
Figure 6:
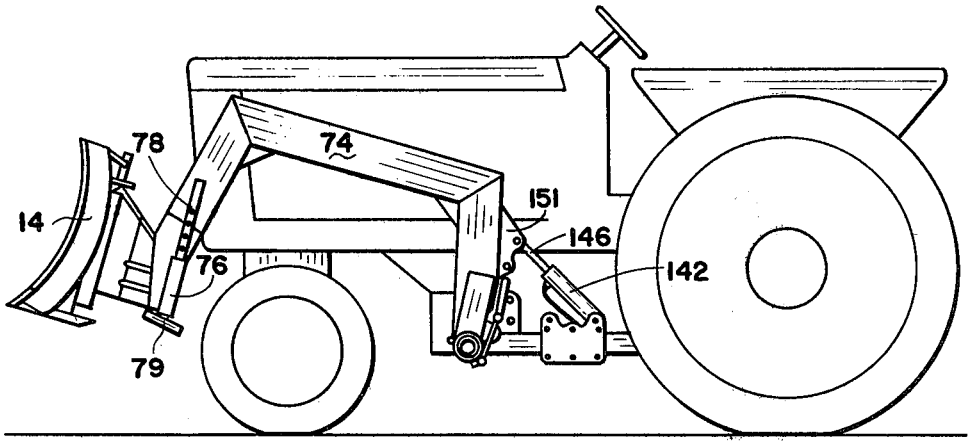

Referring now to FIGS. 5 and 6, the method of attaching the dozer blade 14 and its lift frame 74 to the push frame 124 of a tractor 140 are shown. Prior to assembly parallel push frame arms 124 are suitably attached to the rear axle housing of the tractor and forwardly to the underchassis as, for example, using plate 130. Extending transversely outward of the frame 74 on each side of the tractor are bearing sleeves 132. The tractor 140 is then driven into a position substantially as shown in FIG. 5. The parallel U-shaped arms 74 are situate above and over the front axle of the tractor. A hydraulic cylinder 142 is attached to a bracket 144 which is positioned on the push frame 124 on each side. The push rod 146 of the hydraulic cylinder is attached to the lower opening 148 of bracket 150. The hydraulic lines are attached and the hydraulic power system of the tractor is then utilized to draw the assembled dozer blade 14 and lift frame arm 74 into a position such that the hinged collar generally designated by the numeral 152 is drawn into engagement with the bearing sleeve 132. The key to the assembly here is the placement of the pipe stand 78, found on each of the lift frames 74, which rest via plate 79 upon the ground and provide a balance or fulcrum point for easily moving the hinged sleeve 152 into the bearing sleeve 132.

FIG. 6 described and shows the assembly attached to the tractor, the hydraulic cylinder 142 and its piston 146 being then attached to the upper opening 151 of the bracket 150.

Figure 7:
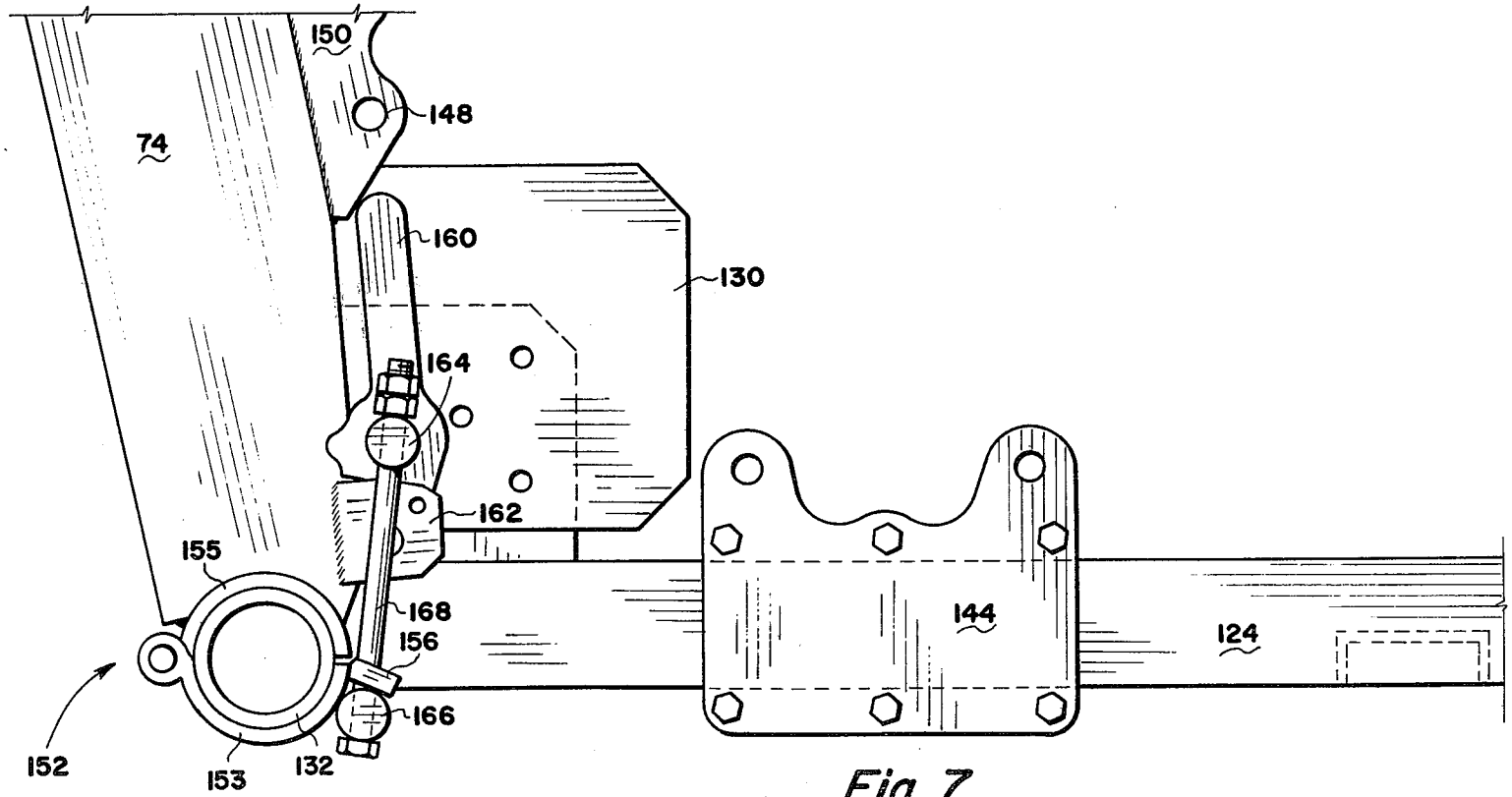
FIG. 7 is a partial side elevational view of the lift frame attachment assembly of FIGS. 1, 5, and 6.
Figure 8:
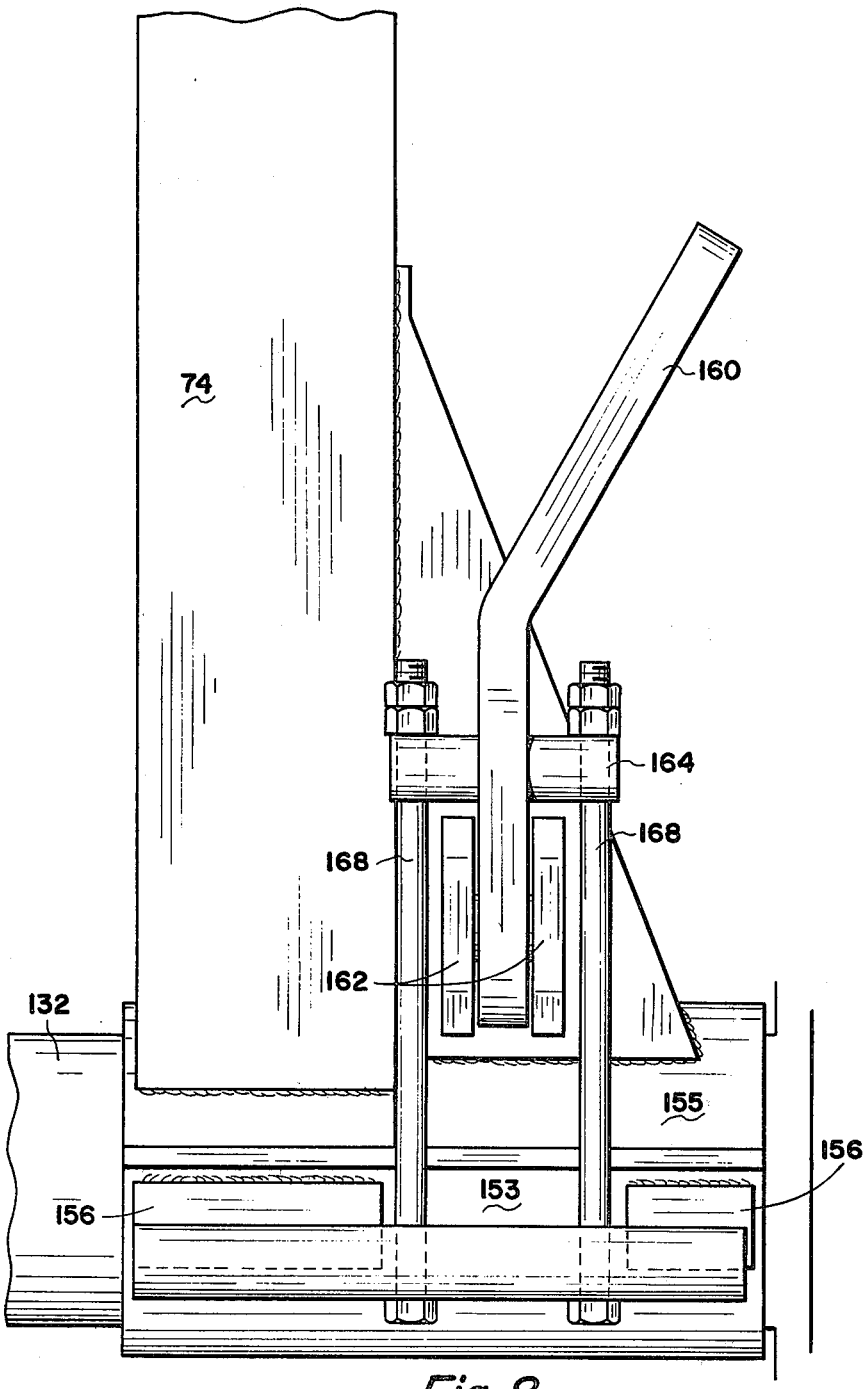
FIG. 8 is a partial rear elevational view depicting the fastening clamp means of FIG. 7, and corresponds to the right-hand side, looking forward.

Referring now to FIGS. 7 and 8, the off-center clamp used in retaining the lift frame 74 to the push frame 124 is shown in side elevation and in rear elevational view. The clamping sleeve assembly 152 includes an upper fixed sleeve 155 and a hinged lower sleeve 153, the lower sleeve including a lip portion 156. Handle 160 is pivoted to an extension bracket 162 and includes an upper transverse rod 164 and a lower transverse rod 166, interconnected by bolts 168. By placing the handle in a down position and interconnecting lower transverse rod 166 beneath the lip 166, the handle is then rotated in a counterclockwise direction moving the hinged collar 153 upward and about the bearing sleeve 132 in an off-center relationship to be retained thereby. Suitable adjustments of the connection may be made by lengthening or shortening the distance between the head of the bolt 168 and its threaded part.

Attached herewith are instruction manuals for two-wheel-drive tractors and four-wheel-drive tractors of the apparatus of this invention, which are incorporated herein by reference. These manuals are identified as follows: Waldon Instruction Manuals for Dozer Hydraulic Angle and Tilt Models: D-852; D-952; D-1052 for 2 wheel drive tractors and 4-wheel drive tractors. Waldon, Incorporated, Fairview, Okla. These manuals are also identified as Form Nos. 216291-7-78 and 2163179-78.

What is claimed is:

1. A forward mountable dozer blade for a 4-wheel drive tractor comprising:

a push frame located beneath the tractor, said push frame having at its forward end outwardly extending bearing sleeves transverse to said push frame and located between the front and back wheels on each side of said tractor, means on said push frame to attach one end of a hydraulic piston or cylinder;

a lift frame assembly comprising parallel side members each of which, in a side view, are inverted U-shaped with a bight portion connecting a forward and rearward leg so as to extend up and over the front wheels or axle of said tractor, the rearward legs of each said side member including a clampable collar for pivotal attachment to the corresponding bearing sleeve of said push frame and means on at least one of said rearward legs to attach the other end of said hydraulic piston or cylinder, to pivot said lift frame up and down, said lift frame assembly having means at its forward end to attach a material handling device such as a dozer blade, said lift frame further including at the bottom of each of said forward legs a vertically adjustable lift stand, said stand positionable on the ground behind said dozer blade so as to create a fulcrum point when said lift frame assembly rests upon the ground such that said clampable collar will clear said front wheels of said tractor when driven into position to connect said left frame assembly.

* * * * *